US007281939B1

(12) United States Patent
Stock

(10) Patent No.: US 7,281,939 B1
(45) Date of Patent: Oct. 16, 2007

(54) BOLT DRIVEN CONNECTOR

(75) Inventor: Christopher W. Stock, Romulus, MI (US)

(73) Assignee: SEWS-DTC, Inc., Northville, MI (US)

( * ) Notice: Subject to any disclaimer, the term of this patent is extended or adjusted under 35 U.S.C. 154(b) by 0 days.

(21) Appl. No.: 11/654,104

(22) Filed: Jan. 17, 2007

(51) Int. Cl.
*H01R 13/627* (2006.01)

(52) U.S. Cl. ..... 439/364; 439/752

(58) Field of Classification Search ..... 439/362, 439/364, 752
See application file for complete search history.

(56) References Cited

U.S. PATENT DOCUMENTS 4,952,166 A 8/1990 Nagasaka et al.
5,000,693 A 3/1991 Hatagishi et al.
5,201,625 A * 4/1993 Takenouchi et al. ..... 411/369
5,228,867 A * 7/1993 Nagamine ..... 439/364
5,486,122 A * 1/1996 Oda et al. ..... 439/752
5,533,909 A 7/1996 Endo et al.
5,720,624 A 2/1998 Ikeda
6,659,810 B2 * 12/2003 Okabe et al. ..... 439/701
2002/0182941 A1 12/2002 Okabe et al.

* cited by examiner

*Primary Examiner*—Thanh-Tam Le
(74) *Attorney, Agent, or Firm*—Gerald E. Hespos; Anthony J. Casella

(57) ABSTRACT

A bolt-driven connector (10; 70) includes a housing (12; 72) with cavities (24; 84) extending in front to rear directions through the housing (12; 72). At least one position assurance slot (36, 38; 90) extends into the housing (12; 72) in a direction transverse to the cavities (24; 84) and slidably receives at least one TPA member (46, 48; 92) for assuring the position of the terminal fittings in the cavities (24; 84). A threaded insert (40) is held connector (10; 70) and is prevented from rotating relative to the housing (12; 72) by walls (30) the housing (12) or walls (98) of the TPA member (92). Forward movement of the threaded insert (40) is prevented by a wall (32; 87) of the housing (12; 72) and rearward movement is prevented by either a wall (87) of the housing (72) or a wall (56, 58) of the TPA member (46, 48).

8 Claims, 8 Drawing Sheets

BOLT DRIVEN CONNECTOR

BACKGROUND OF THE INVENTION

1. Field of the Invention

The invention relates to a connector with two housings and a bolt that generates forces to connect or disconnect the housings.

2. Description of the Related Art

Prior art connectors include first and second housings that can be connected to one another. Terminal fittings are mounted in each housing. The terminal fittings in the first housing are disposed to mate with the terminal fittings in the second housing when the housings are connected properly.

Connectors that are used in automotive vehicles often affect critical aspects of the vehicle operation. Performance of these important vehicular functions depends partly upon proper positioning of the terminal fittings in the housings. Proper positioning of the terminal fittings is complicated by the frequent vibration of the automotive vehicle and the broad range of temperature to which the vehicle may be exposed during normal use. Most connectors include locks to retain the terminal fittings in the housing. A common lock is formed unitarily with the housing and deflects as the terminal fitting is being inserted into the housing. The lock then returns resiliently to an undeflected condition when the terminal fitting is inserted properly and holds the terminal fitting in the housing. Other connectors include resiliently deflectable locks on the terminal fittings that engage a rigid structure on the housing.

Locks on the terminal fittings slide against the housing during insertion and produce frictional resistance forces that must be overcome to complete the terminal insertion. An operator could interpret these resistance forces as an indication of complete insertion and could stop the terminal insertion prematurely. An insufficiently inserted terminal fitting may not connect properly with a mating terminal fitting and could affect a critical circuit. As a result, most vehicle manufacturers require connectors to have terminal position assurance (TPA) members. A TPA member typically is formed separately from the housing and can be moved relative to the housing between a partial locking position and a full locking position. The TPA member can be moved to the full locking position if all of the terminal fittings have been inserted properly. However, an insufficiently inserted terminal fitting will interfere with the TPA member will impede the movement of the TPA member to the full locking position. Thus, an inability to move the TPA member to the full locking position any indicates that one or more terminal fittings have not been inserted properly.

Mating terminal fittings slide against one another during connection and create a friction resistance forces that must be overcome to connect the two housings of the connector properly. Similar resistance forces are generated during disconnection and must be overcome. The magnitude of the resistance forces is affected by the size and shape of the terminal fittings and the number of terminal fittings in each housing. Many prior art connectors include mechanical devices to facilitate connection and disconnection. The mechanical devices on some connectors include an internally threaded member in one housing and an externally threaded bolt in the mating housing. The bolt engages the internally threaded member during an early stage of mating. The bolt then can be rotated and the interengaged threads urge the housings and their terminal fittings into a full mated condition. Rotation of the bolt in the opposite direction separates the housings and the terminal fittings. The internally threaded member typically is a nut that is formed separately from the housing. Some nuts are secured in the housing by insert molding. Insert molding involves positioning the nut in the cavity of the mold that is used to form the housing. Resin then is injected into the housing and forms a unitary matrix that surrounds and supports exterior regions of the nut. Insert molded nut/housing assemblies perform well, but are very costly. Other nuts are press fit into the resin housing. More particularly, the nut has a knurled exterior surface that bites into the resin of the housing to hold the nut in place. Press fitting is much less costly than insert molding. However the press fit nut is positioned less securely and less precisely.

SUMMARY OF THE INVENTION

The invention relates to a bolt driven connector assembly. The connector assembly includes first and second housings that are connectable with one another along a mating direction. At least one first terminal fitting is mounted in the first housing and at least one second terminal fitting is mounted in the second housing. The first and second terminal fittings are connectable with one another along the mating direction as the first and second housings are connected.

At least one terminal position assurance (TPA) member is mounted in at least the first housing for movement between a partial locking position and a full locking position. The TPA member is configured to permit insertion of the first terminal fitting into the first housing and withdrawal of the first terminal fitting from the first housing when the TPA member is in the partial locking position. The TPA member can be moved to the full locking position if the first terminal fitting has been mounted properly in the first housing. However, the TPA member cannot be moved to the full locking position if the first terminal fitting is mounted only partly into the first housing. Thus, an inability to move the TPA member to the full locking position provides an indication that the first terminal fitting has not been inserted sufficiently. An operator then can insert the first farther into the first housing so that the TPA member can be advanced to the full locking position.

The connector assembly further includes at least one nut and at least one bolt. The nut preferably includes an array of internal threads and the bolt preferably includes an array of external threads that are configured to mate rotatably with the threads of the nut.

The bolt preferably is mounted rotatably in the second housing so that the external threads of the bolt project at a mating end of the second housing. The nut preferably is held nonrotatably in the first housing at least partly by the TPA member and/or by structure form integrally or unitarily with the first housing. The nut also preferably is held fixedly in the first housing in a manner that prevents movement of the nut along the mating direction. As a result, threaded engagement of the bolt with the nut will move the first housing towards or away from the second housing.

The nut preferably has a non-cylindrical outer periphery and the TPA member or the first housing may include a recess configured to engage at least part of the non-cylindrical outer periphery of the nut for holding the nut nonrotatably with respect to both the TPA member and the first housing. The first housing preferably has at least one stop wall for substantially preventing movement of the nut along the mating direction. The TPA member also may have a wall for cooperating with the stop wall of the first housing to limit movement of the nut along the mating direction. The retention of the nut in the first housing is secure, reliable, inexpensive and easily achieved.

The first housing preferably is formed with a slot for receiving the TPA member. The slot preferably extends into the first housing at an angle to the mating direction and most preferably substantially normal to the mating direction. The slot preferably has a dimension along the mating direction for substantially preventing or limiting movement of the nut along the mating direction relative to the first housing. Thus, the TPA member prevents the nut from rotating and walls of the first housing that define the slot prevent the nut from moving along the mating direction.

The first housing may include a recess with non-cylindrical wall for non-rotatably retain the nut. The TPA member may be configured for limiting movement of the nut along the mating direction.

The TPA member may be single integral or unitary structure. Alternatively, the TPA member may be formed from a plurality of parts that are mounted into the first housing from different directions.

The at least one first terminal fitting preferably comprises a plurality of first terminal fittings mounted in the first housing. The first terminal fittings can be mated respectively with a corresponding plurality of second terminal fittings in the second housing. The bolt and the nut preferably are mounted substantially centrally in the first and second housings respectively to achieve a substantial balancing of forces during mating or unmating.

DETAILED DESCRIPTION OF THE PREFERRED EMBODIMENTS

Figure 1:
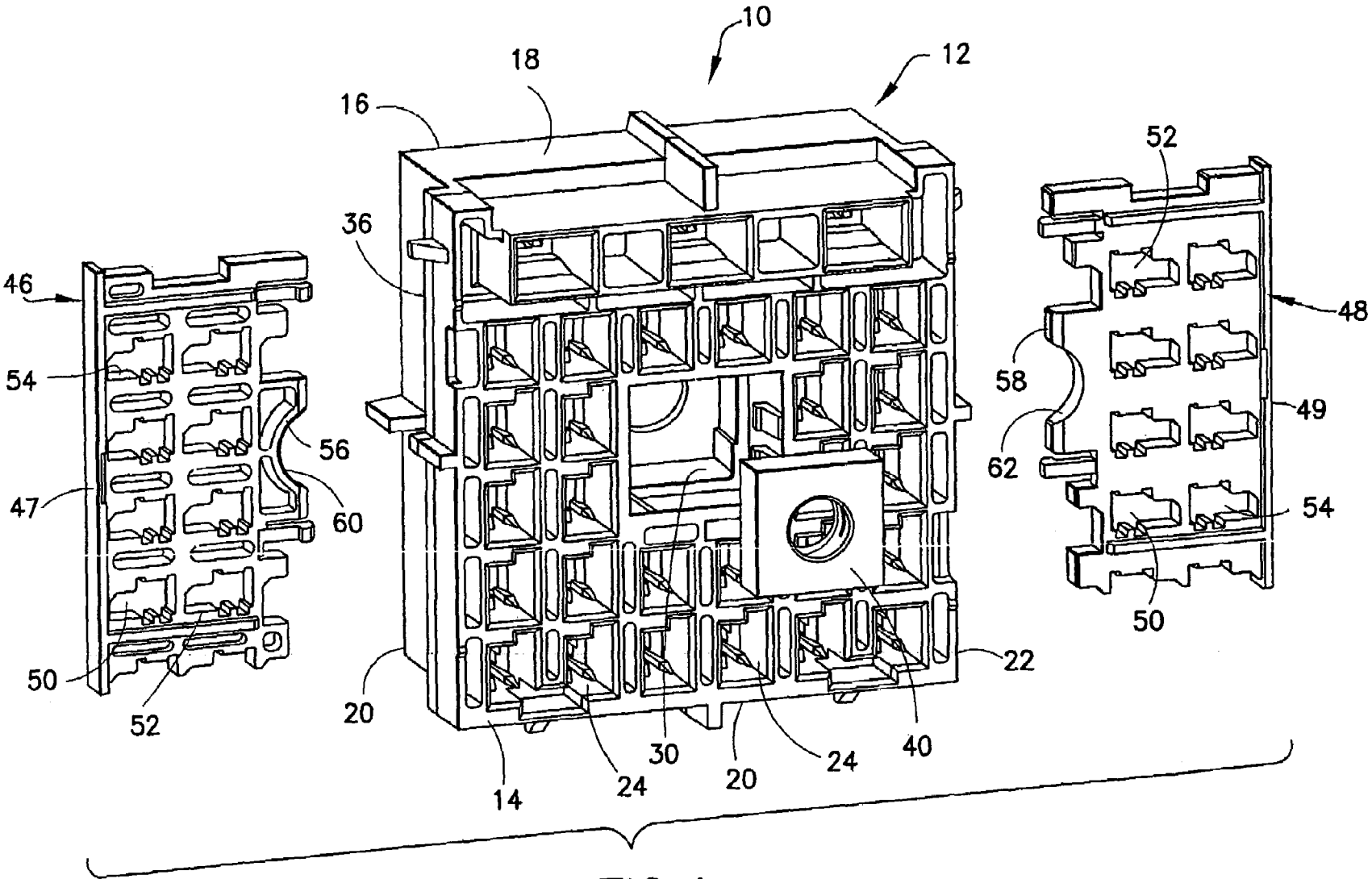
FIG. 1 is an exploded perspective view of a bolt driven connector assembly in accordance with a first embodiment of the invention.
Figure 2:
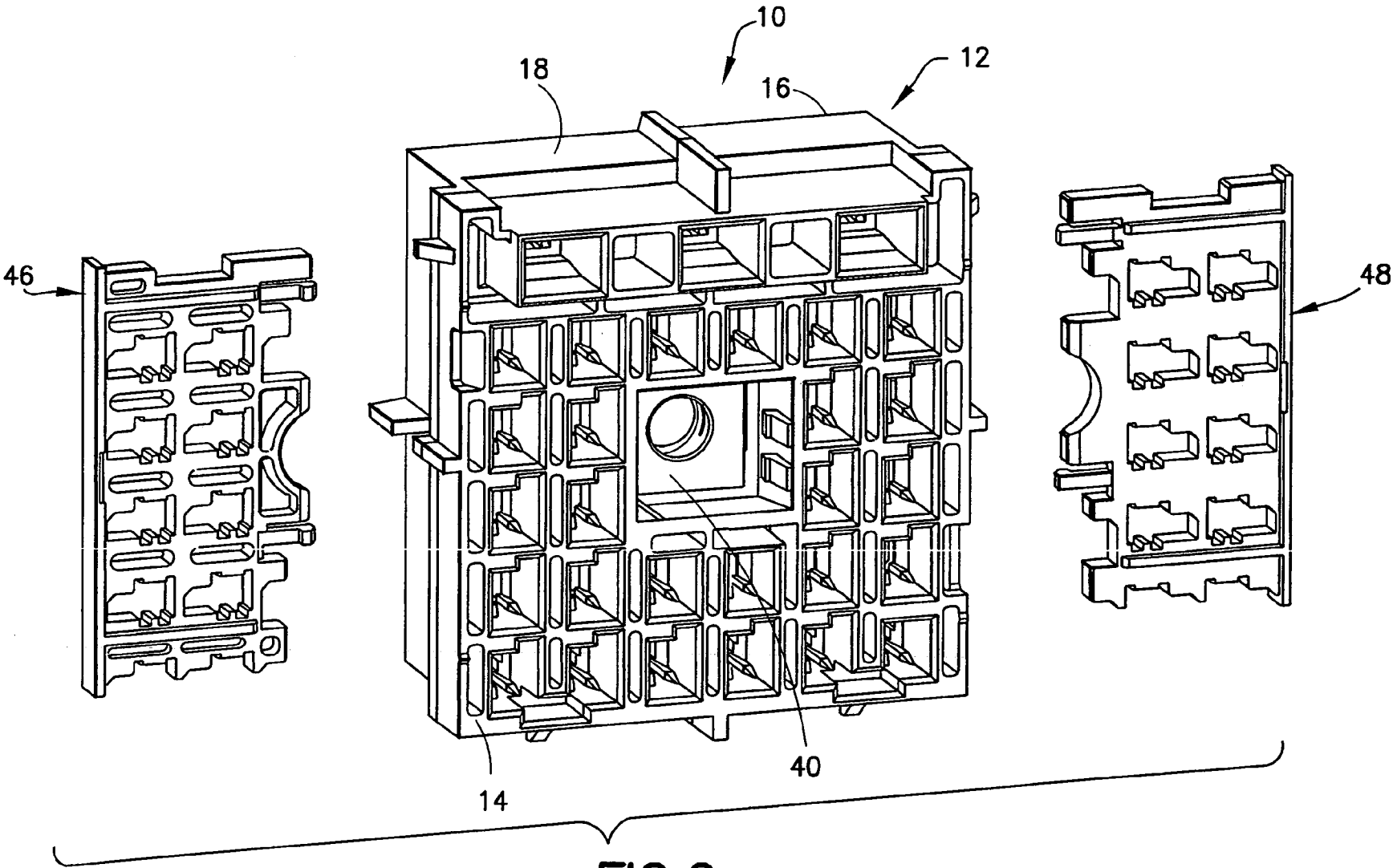
FIG. 2 is an exploded perspective view of the bolt-driven connector assembly of FIG. 1 with the nut in place in the housing.
Figure 3:
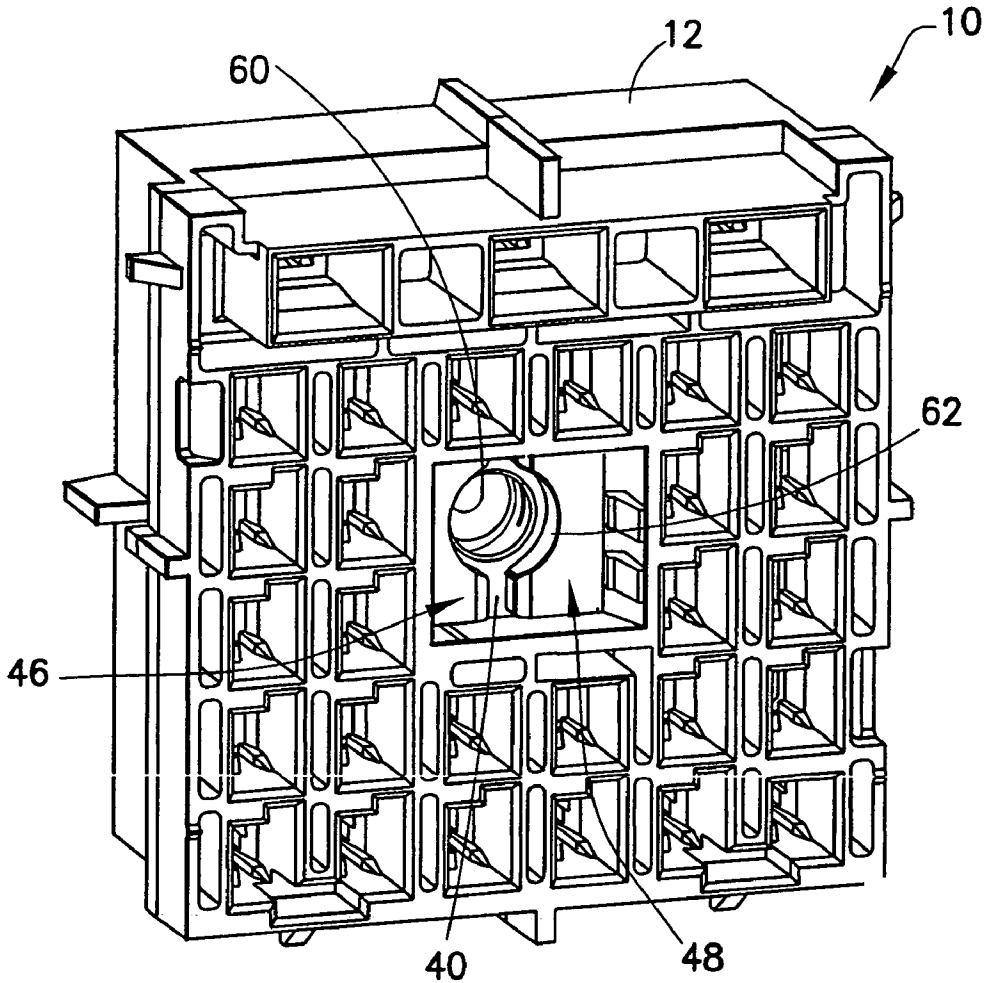
FIG. 3 is a perspective view of the connector assembly of FIGS. 1 and 2 in a fully assembled condition.
Figure 5:
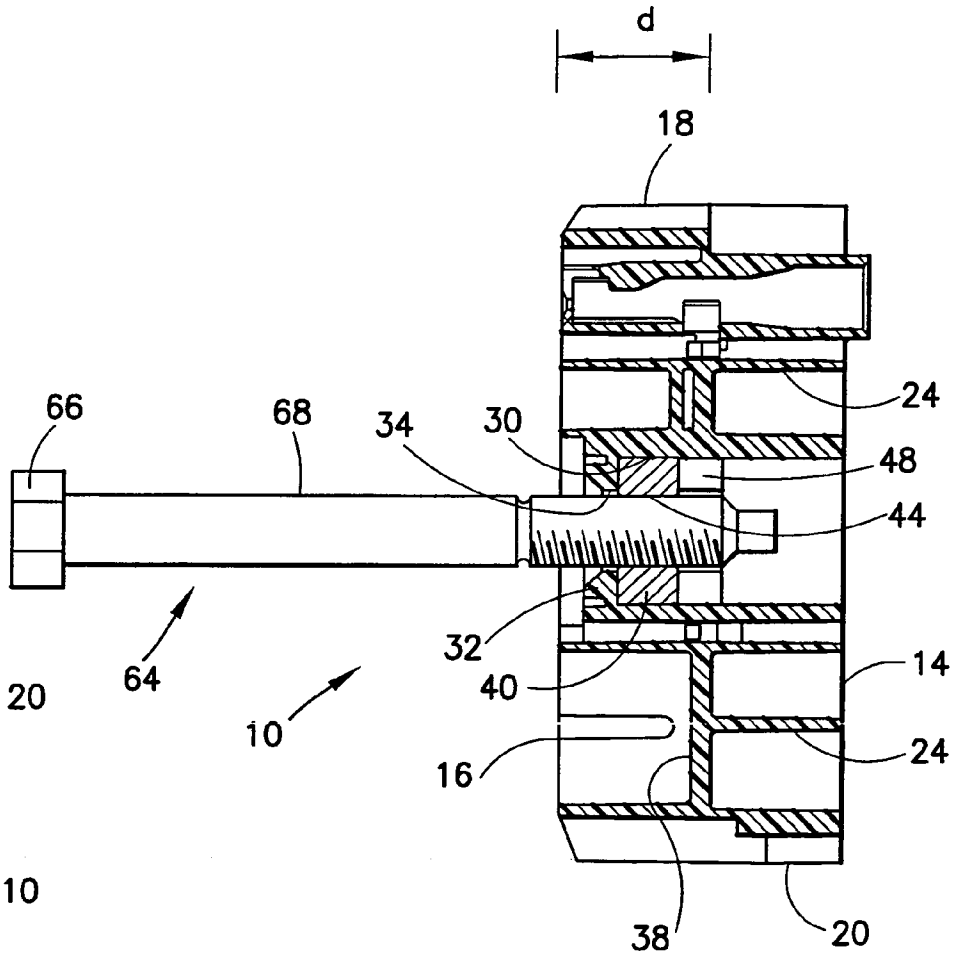
FIG. 5 is a cross-sectional view taken along line 5-5 in FIG. 4.
Figure 4:
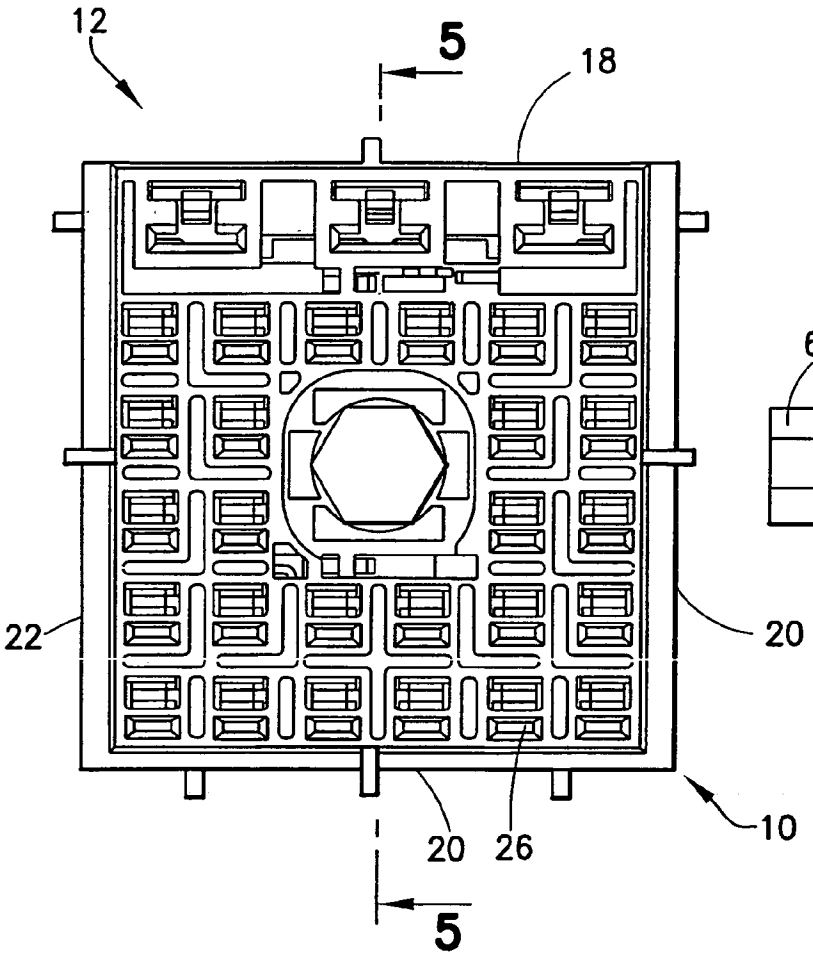
FIG. 4 is a top plan view of the connector assembly of FIGS. 1-3 with the bolt in a pre-mating position.

A bolt driven connector assembly in accordance with a first embodiment of the invention is identified by the numeral 10 in FIGS. 1-5. The connector assembly 10 includes a housing 12 that is molded unitarily from a non-conductive synthetic resin. The housing 12 has a substantially rectilinear block shape with opposite rear and front ends 14 and 16 respectively. The rear end 14 of the housing 12 is configured for connection with a mating housing (not shown). Opposite top and bottom walls 18 and 20 extend from the rear end 14 to the front end 16 of the housing 12. The terms top and bottom are used herein as a convenient frame of reference, and do not imply a required gravitational frame of reference for the connector 10. Opposite first and second side walls 20 and 22 also extend between the rear and front ends 14 and 16 of the housing 12 and connect the top and bottom walls 18 and 20.

Cavities 24 extend through the housing 12 along direction A from the rear end 16 substantially to the rear end 14. The cavities 24 are configured to receive terminal fittings (not shown). Portions of the cavities 24 at the rear end 14 of the housing 12 have openings 26 so that the terminal fittings in the housing 12 can mate with terminal fittings in the mating housing. The housing 12 may be formed with locks that project into the respective cavities 24 for at least partly locking the terminal fittings in the cavities. The locks are not illustrated herein, and can take any of the configurations that are well known in the prior art.

An insert recess 30 extends into the rear end 14 of the housing 12 and continues to a rear wall 32 near the front end 16 of the housing 12. The rear wall 32 is formed with a substantially circular bolt-mounting aperture 34 that is substantially symmetrical with an axis extending centrally through the insert recess 30. The insert recess 30 is substantially square in cross section, but other polygonal or non-cylindrical shapes can be provided for the insert recess 30.

First and second position assurance slots 36 and 38 extend respectively into the first and second side walls 20 and 22 and continue into the housing 12 in a direction substantially transverse to the direction A. The slots 36 and 38 intersect the respective cavities 24 and the insert recess 30 at a position forward of the rear wall 32 of the insert recess 30 by a distance "d".

The connector 10 further includes a threaded insert 40 with opposite planar surfaces 42 defining a thickness approximately equal to the distance "d" between the position assurance slots 36 and 38 and the rear wall 32 of the insert recess 30. A substantially square outer periphery extends between the planar surfaces 42 and defines a shape conforming to the cross-sectional shape of the insert recess 30. An internally threaded aperture 44 extends through the threaded insert 40 and aligns with the bolt hole 34 when the threaded insert 40 is in the insert recess 30.

The connector 10 further includes first and second TPA members 46 and 48. The TPA members 46 and 48 have pushing walls 47 and 49 respectively that can be pushed or otherwise manipulated to slide the first and second TPA members 46 and 48 into the respective position assurance slots 36 and 38 for temporary retention at a partial locking position. However, pushing forces can be exerted on the pushing walls 47 and 49 for sliding the TPA members 46, 48 more deeply into the respective position assurance slot 36, 38 and into a full locking position. The TPA members 46 and 48 each have apertures 50 disposed to align substantially with the respective cavities 24. More particularly, each aperture 50 has a cross-sectionally large portion 52 that aligns with the cavity when the TPA member 46, 48 is in the partial locking position. However, each aperture 50 also has a cross-sectionally small portion 54 that aligns with the cavity when the TPA member 46, 48 is in the full locking position. The cross-sectionally large portions 52 are dimensioned and configured to permit cross-sectionally large front parts of the respective terminal fittings to be inserted through the large portions 52 of the apertures 50 and into the cavities 24. However, the cross-sectionally small portion 54 of each aperture 50 corresponds to the size and shape of a small rear part of a terminal fitting and is smaller than the large front part of the terminal fittings.

The TPA members 46, 48 also have also have insert retaining walls 56 and 58 respectively at positions opposite the corresponding pushing walls 47 and 49. The insert retaining walls 56, 58 are disposed to substantially abut and align with the insert recess 30 when the TPA members 46 and 48 are in the full locking position. Additionally, the insert retaining walls 56, 58 have semicircular recesses 60 and 62 that oppose each other to define a substantially circular opening that aligns with the bolt-mounting aperture 34 in the rear wall 32 of the insert recess 30 of the housing 12.

The mating connector includes a bolt 64 with a head 66 at one end and array of external threads 68 at the opposite end. The threads 68 of the bolt are dimensioned to threadedly engage the internal threads of the threaded insert 40.

The connector 10 is assembled by mounting the threaded insert 40 into the insert recess 30 of the housing 12 so that the internally threaded aperture 44 aligns with the bolt-mounting aperture 34 in the rear wall 32 of the insert recess 30. The side walls of the insert recess 30 prevent the threaded insert 40 from moving in directions parallel to the planar surfaces 42 of the threaded insert 40.

Assembly of the connector 10 proceeds by sliding the first and second TPA members 46 and 48 into the respective first and second position assurance slots 36 and 38 to the temporary locking position. As a result, the large portions 52 of the apertures 50 align respectively with the cavities 24 in the housing 12. Additionally, the insert retaining walls 56 and 58 move partly into the insert recess 30 on a side of the threaded insert 40 opposite the rear wall 32 of the inserted recess 30. Thus, the threaded insert 40 is sandwiched between the rear wall 32 and the inset retaining wall 56 and 58 of the TPA members 46 and 48. The terminal fittings (not shown) then can be inserted into the cavities 24 in rear to front directions.

The TPA members 46 and 48 then are pushed to the fully locked position. As a result, the small portions 54 of the apertures 50 move onto the small rear ends of the terminal fittings to prevent the terminal fittings from being moved rearwardly out of the cavity 24. The large front end of any terminal fitting that has not been inserted sufficiently will remain in the first or second position assurance slot 36 or 38. As a result the associated TPA member 46 or 48 will be unable to advance to the full locking position, thereby providing an indication that one or terminal fittings has not been inserted inadequately. The position of the respective terminal fittings then can be checked, and one or more of the terminal fittings can be inserted further. The TPA members 46 and 48 the can be pushed to the fully locked position.

The connector 10 then can be positioned in juxtaposed relationship to a mating connector so that the threaded end 68 of the bolt 64 will advance into the internally threaded aperture 44 of the threaded insert 40. A wrench or other such tool can be applied to the head 66 of the bolt to rotate the bolt 64 into the internally threaded aperture 44 of the threaded insert 40 to pull the connector 10 and the mating connector into a mating condition. Rotation of the bolt 64 and the engagement of the threaded end 68 of the bolt 64 with the internal threads in the mating connector generate rotational and axial forces on the threaded insert 40 in the housing 12. However, the walls of the insert recess 30 closely engage the outer periphery of the threaded insert 40 to resist rotational force with good effect. Additionally, the rear wall 32 of the insert recess 30 and the insert retaining walls 56 and 58 of the respective TPA members 46 and 48 sandwich the threaded insert 40 from opposite sides to resist axial forces on the threaded insert 40 during both connection and disconnection.

Figure 6:
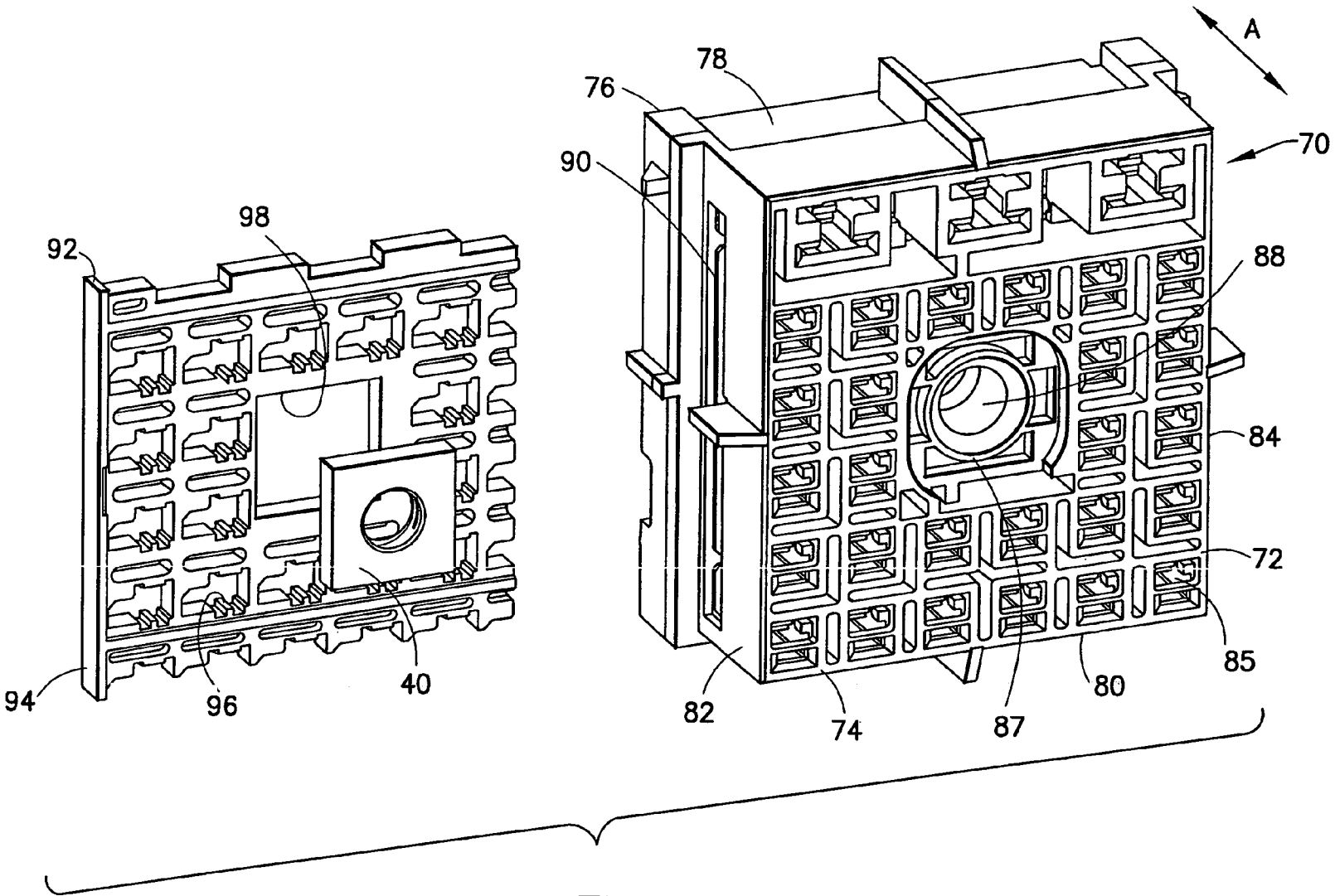
FIG. 6 is an exploded perspective view of a bolt driven connector assembly in accordance with a second embodiment of the invention.
Figure 7:
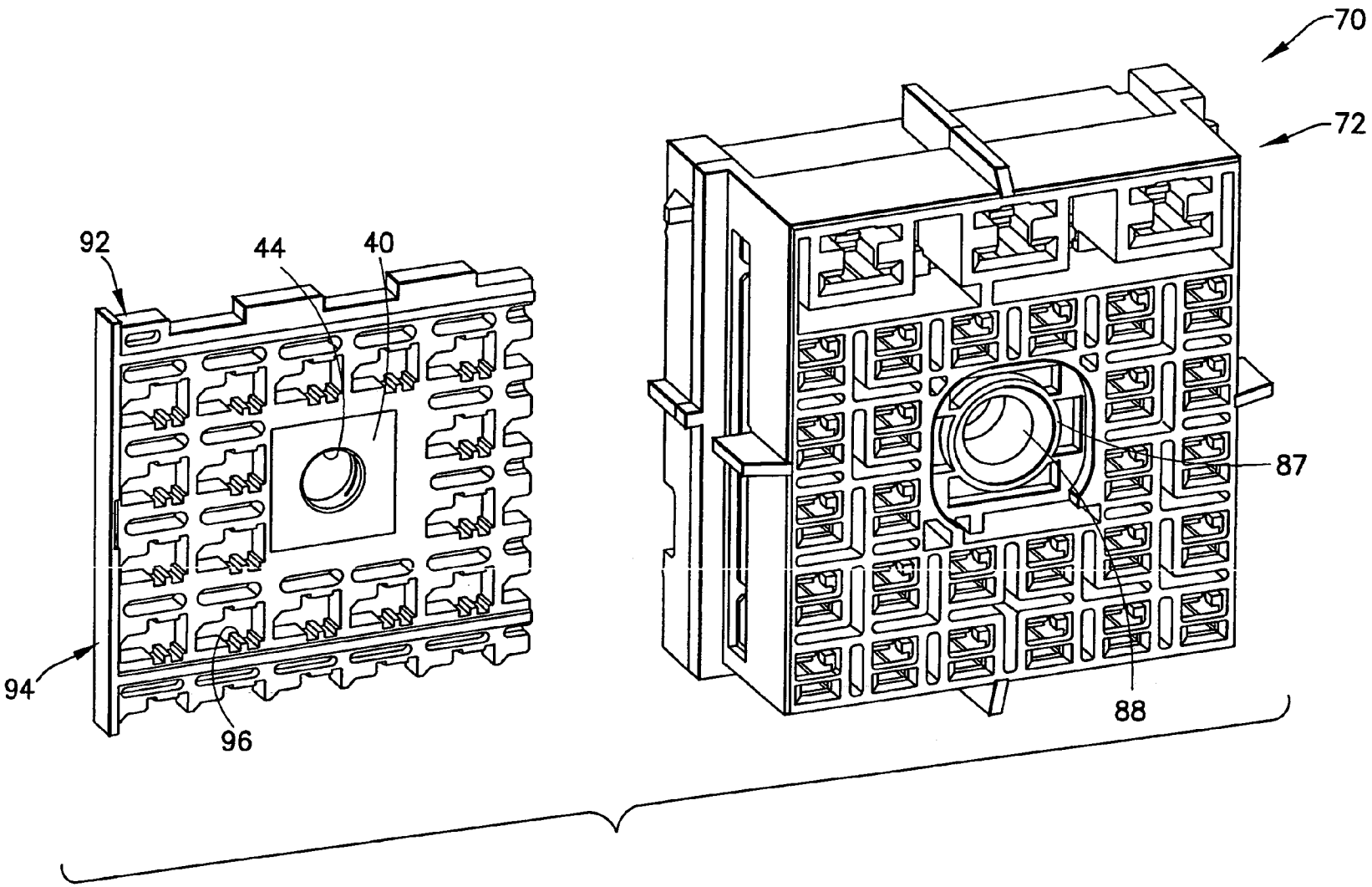
FIG. 7 is an exploded perspective view of the bolt-driven connector assembly of FIG. 6 with the nut in place in the housing.
Figure 8:
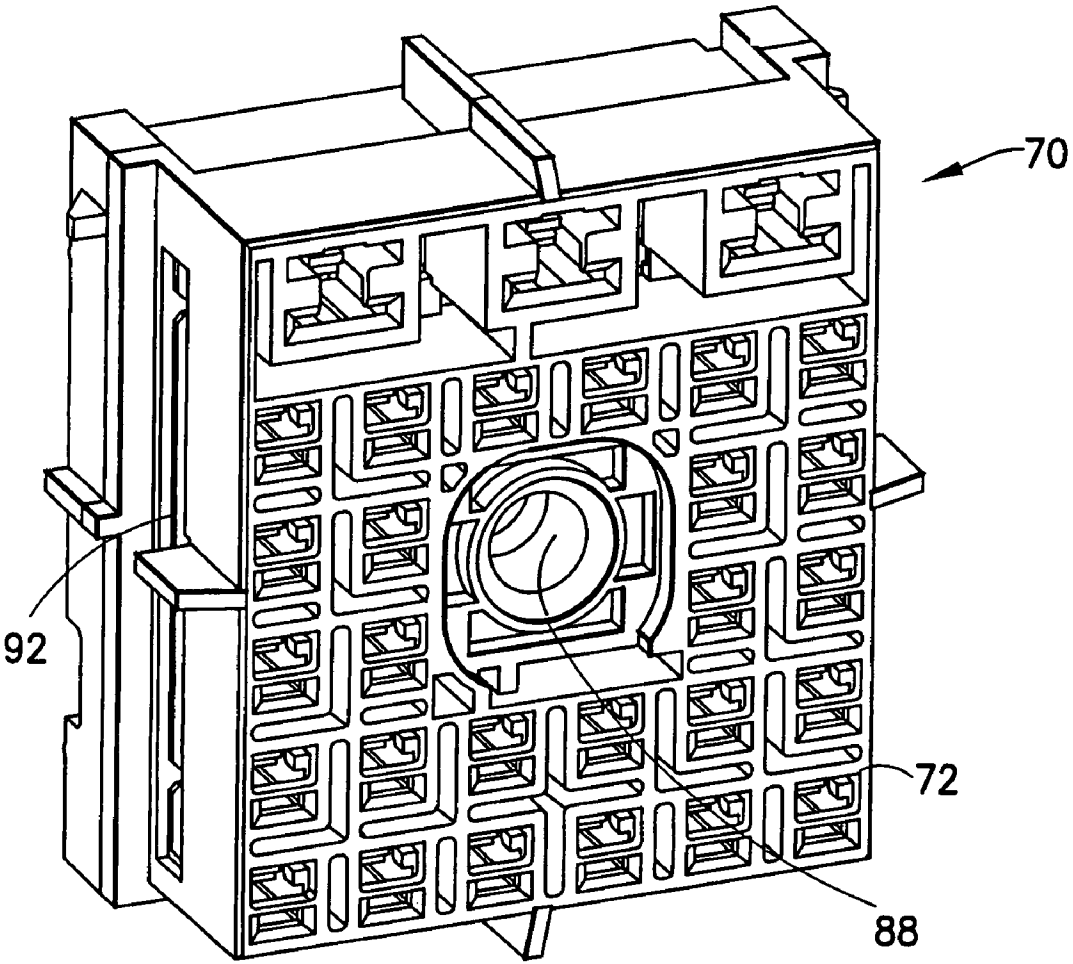
FIG. 8 is a perspective view of the connector assembly of FIGS. 6 and 7 in a fully assembled condition.
Figure 10:
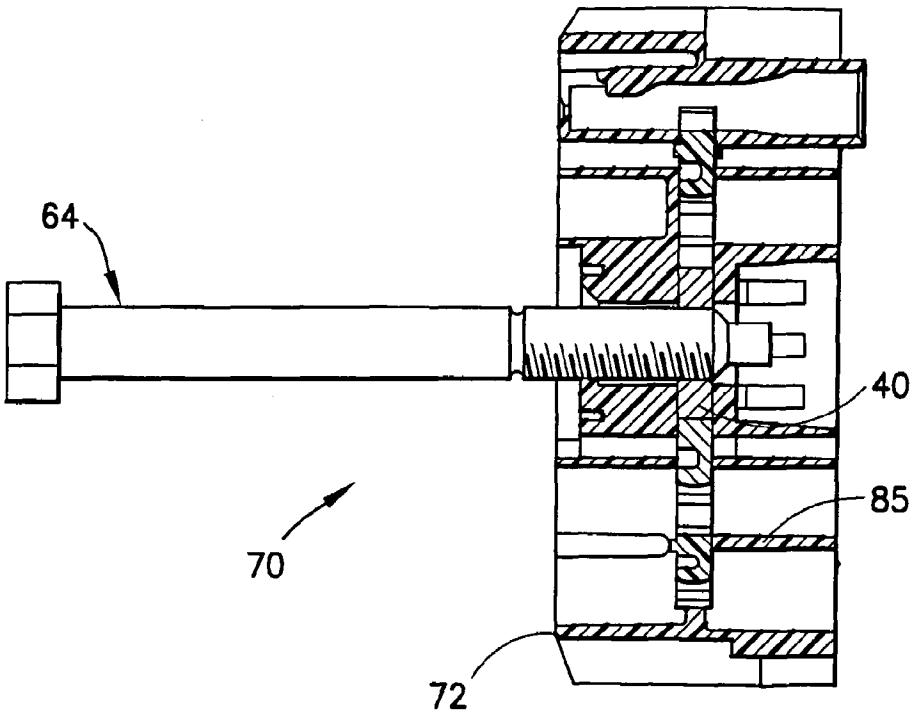
FIG. 10 is a cross-sectional view taken along line 10-10 in FIG. 9.
Figure 9:
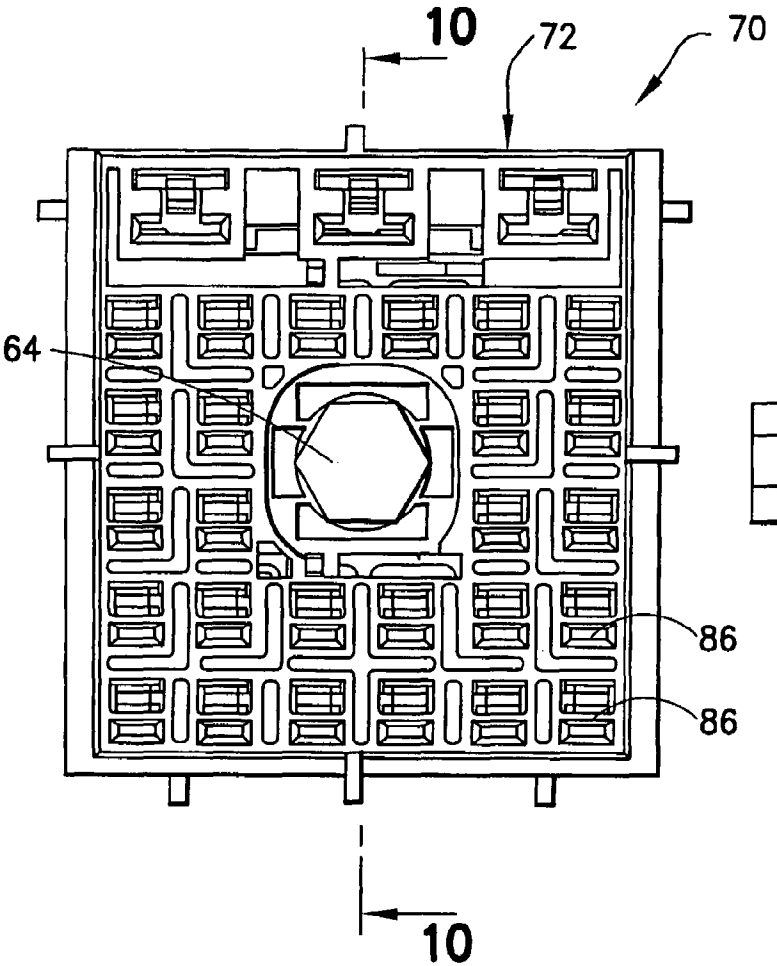
FIG. 9 is a top plan view of the connector assembly of FIGS. 6-8 with the bolt in a pre-mating position.

FIGS. 6-10 show a connector assembly 70 in accordance with a second embodiment of the invention. The connector assembly 70 includes a housing 72 that is molded unitarily from a non-conductive synthetic resin. The housing 72 has a substantially rectilinear block shape with opposite front and rear ends 74 and 76 respectively. The front end 74 of the housing 72 is configured for connection with a mating housing (not shown). Opposite top and bottom walls 78 and 80 extend from the front end 74 to the rear end 76 of the housing 72. The terms top and bottom are used herein as a convenient frame of reference, and do not imply a required gravitational frame of reference for the connector 70. Opposite first and second side walls 82 and 84 also extend between the front and rear ends 74 and 76 of the housing 82 and connect the top and bottom walls 78 and 80.

Cavities 85 extend through the housing 72 along direction "A" from the rear end 76 substantially to the front end 74. The cavities 85 are configured to receive terminal fittings (not shown). Portions of the cavities 85 at the front end 74 of the housing 72 have openings 86 so that the terminal fittings in the housing 72 can mate with terminal fittings in the mating housing. The housing 72 may be formed with locks that project into the respective cavities 85 for at least partly locking the terminal fittings in the cavities. The locks are not illustrated herein, and can take any of the configurations that are well known in the prior art.

Insert support walls 87 are formed centrally at front and rear ends of the housing 72 and substantially circular bolt mounting apertures 88 extend through the insert support walls 87. The bolt mounting apertures 88 align with one another and hence provide communication through the housing 72 from the front end 74 to the rear end 76 at a position that is substantially symmetrical with an axis extending centrally through the housing 72.

A position assurance slot 90 extends into the first side wall 82 and continues into the housing 72 in a direction substantially transverse to the direction A to the second side wall 84. The slot 90 intersects the respective cavities 85 and the bolt mounting aperture 88. Additionally, the slot 90 has a front to rear dimension "d".

The connector 70 further includes a TPA member 92 that is dimensioned for slidable insertion into the position assurance slot 90. The TPA member 92 has pushing wall 94 that can be pushed or otherwise manipulated to slide the TPA member 92 into the position assurance slot 90 for temporary retention at a partial locking position. However, pushing forces can be exerted on the pushing wall 94 for sliding the TPA member 92 more deeply into the position assurance slot 90 and into a full locking position. The TPA member 92 has apertures 96 disposed to align substantially with the respective cavities 84. Each aperture 96 is structurally and functional substantially the same as the apertures 50 of the first embodiment, and hence are not described again herein.

The TPA member 92 also has also have an insert recess 98 that is dimensioned and configured to receive and engage the threaded insert 40 described above with respect to the first embodiment. More particularly, the insert recess 98 is substantially square in cross section, but other polygonal or non-cylindrical shapes that conform to the shape of the threaded insert 40 can be provided. Additionally, the axial or front to rear dimensions of the TPA member 92 and the threaded insert 40 substantially conform to one another and to the axial or front to rear dimension of the position assurance slot 90.

The connector 70 is assembled by mounting the threaded insert 40 into the insert recess 98 of the TPA member 92. Assembly of the connector 70 proceeds by sliding the TPA member 92 into the position assurance slot 90 to the temporary locking position. As a result, the large portion of each aperture 96 aligns with the respective cavity 85 in the housing 72. Additionally, the internal walls of the housing 72 that define the position assurance slot 90 slidably engage the opposite planar surfaces 42 of the threaded insert 40 to prevent front to rear movement of the threaded insert 40. The terminal fittings (not shown) then can be inserted into the cavities 74 in rear to front directions.

The TPA member 92 then is pushed to the fully locked position. As a result, the small portions of the aperture 96 moves onto the small rear ends of the terminal fittings to prevent the terminal fittings from being moved rearwardly out of the cavity 84. The large front end of any terminal fitting that has not been inserted sufficiently will remain in the position assurance slot 90. As a result the TPA member 92 will be unable to advance to the full locking position, thereby providing an indication that one or terminal fittings has not been inserted inadequately. The position of the respective terminal fittings then can be checked, and one or more of the terminal fittings can be inserted further. The TPA member 92 the can be pushed to the fully locked position.

The connector 70 then can be positioned in juxtaposed relationship to a mating connector so that the threaded end 68 of the bolt 64 in the mating connector will advance into the threaded aperture 44 of the threaded insert 40 in the housing 72. A wrench or other such tool can be applied to the head 66 of the bolt to rotate the bolt 64 into the internally threaded aperture 44 of the threaded insert 40 to pull the connector 70 and the mating connector into a mating condition. Rotation of the bolt 64 and the engagement of the threaded end 68 of the bolt 64 with the internal threaded aperture 44 of the threaded insert 40 generate rotational and axial forces on the threaded insert 40 in the housing 72. However, the walls of the insert recess 98 closely engage the outer periphery of the threaded insert 40 to resist rotational force with good effect. Additionally, the internal wall of the housing 72 that define the position assurance slot 90 sandwich the threaded insert 40 from opposite sides to resist axial forces on the threaded insert 40 during both connection and disconnection.

While the invention has been described with respect to a preferred embodiment, it is apparent that various changes can be made without departing from the scope of the invention, as described by the claims.

The first embodiment has been described with respect to a connector having two TPA members that are inserted from opposite side of the housing. However, the housing can have an insert recess, as in the first embodiment, and only one TPA member configured for holding the threaded insert in the insert recess.

What is claimed is:

1. A bolt-driven connector, comprising:

a housing having opposite front and rear ends, cavities extending through the housing from the rear end substantially to the front end for receiving terminal fittings, at least one bolt mounting aperture extending into the front end of the housing, at least one position assurance slot extending into the housing and intersecting the cavities;

at least one terminal position assurance member slidably inserted in the position assurance slot for intersecting the cavities;

a threaded insert having opposite front and rear surfaces and an internally threaded aperture extending between the front and rear surfaces, the threaded insert being disposed in the housing so that the internally threaded aperture of the threaded insert substantially aligns with the bolt mounting aperture of the housing;

a front support wall formed on one of the housing and the terminal position assurance member and a rear support wall formed on the other of the housing and the terminal position assurance member for limiting front and rear movement of the threaded insert relative to the housing; and side support walls formed at least on the housing for substantially preventing transverse and rotational movement of the threaded insert relative to the housing and the terminal position assurance member.

2. The bolt-driven connector of claim 1, wherein the at least one position assurance slot comprises first and second position assurance slots.

3. The bolt-driven connector of claim 2, wherein the first and second position assurance slots extend onto substantially opposite sides of the housing.

4. The bolt-driven connector of claim 2, wherein the at least one terminal position assurance member comprises first and second terminal position assurance members insertable respectively into the first and second position assurance slots.

5. The bolt-driven connector of claim 1, wherein the housing is molded unitarily from a synthetic resin.

6. The bolt-driven connector of claim 1, wherein the threaded insert has a substantially polygonal outer periphery.

7. A bolt-driven connector, comprising:

a housing having opposite front and rear ends, cavities extending through the housing from the rear end substantially to the front end for receiving terminal fittings, at least one bolt mounting aperture extending at least into the front end of the housing, at least one position assurance slot extending into the housing and intersecting the cavities;

a threaded insert having opposite front and rear surfaces and an internally threaded aperture extending between the front and rear surfaces, the threaded insert being disposed in the housing so that the internally threaded aperture of the threaded insert substantially aligns with the bolt mounting aperture of the housing;

front and rear support walls formed on at least one of the housing and the terminal position assurance member for limiting front and rear movement of the threaded insert relative to the housing; and side support walls formed on the terminal position assurance member for substantially preventing transverse and rotational movement of the threaded insert relative to the housing and the terminal position assurance member.

8. The bolt-driven connector of claim 7, wherein the front and rear support walls are on the housing.

* * * * *